United States Patent [19]

Mate et al.

[11] Patent Number: 5,035,211

[45] Date of Patent: Jul. 30, 1991

[54] INTERNAL COMBUSTION ENGINE

[75] Inventors: David W. Mate, McHenry, Ill.; Duane E. Rogers; Henry C. Billingsley, both of Kenosha, Wis.; George L. Broughton, Zion; Glenn R. Belec, Gurnee, both of Ill.

[73] Assignee: Outboard Marine Corporation, Waukegan, Ill.

[21] Appl. No.: 512,797

[22] Filed: Apr. 23, 1990

[51] Int. Cl.[5] ..... F02M 35/00; F02M 35/04; F02M 35/12

[52] U.S. Cl. ..... 123/198 E; 123/52 M; 123/195 A; 123/52 MB; 181/229; 181/243

[58] Field of Search ..... 181/229, 243; 123/195 A, 198 E, 52 M, 52 MB

[56] References Cited

U.S. PATENT DOCUMENTS

| | | | |
|---|---|---|---|
| 3,505,983 | 4/1970 | Härtel | 123/52 MB |
| 3,791,482 | 2/1974 | Sykora | 181/229 |
| 3,810,526 | 5/1974 | Kawasaki | 181/229 |
| 4,093,039 | 6/1978 | Moore et al. | 181/229 |
| 4,224,919 | 9/1980 | Appelbaum | 123/195 A |
| 4,327,680 | 5/1982 | Dauwalder | 123/198 E |
| 4,448,280 | 5/1984 | Endo | 181/229 |
| 4,559,910 | 12/1985 | Tsuchiyama et al. | 123/198 E |
| 4,569,415 | 2/1986 | Breckenfeld et al. | 181/229 |
| 4,592,316 | 6/1986 | Shiratsuchi et al. | 123/195 A |
| 4,620,607 | 11/1986 | Breckenfeld et al. | 181/229 |
| 4,778,029 | 10/1988 | Thornburgh | 181/229 |
| 4,852,686 | 8/1987 | Sougawa | 181/229 |

FOREIGN PATENT DOCUMENTS

| | | | |
|---|---|---|---|
| 0082567 | 5/1984 | Japan | 123/195 A |
| 0249616 | 12/1985 | Japan | 123/52 MB |

*Primary Examiner*—E. Rollins Cross
*Assistant Examiner*—Thomas N. Moulis
*Attorney, Agent, or Firm*—Michael, Best & Friedrich

[57] ABSTRACT

An internal combustion engine comprising an engine block including a cylinder and a combustion air passage for supplying combustion air to the cylinder, an air silencer communicating with the combustion air passage, and an elastic connector for securing the air silencer to the engine block.

46 Claims, 4 Drawing Sheets

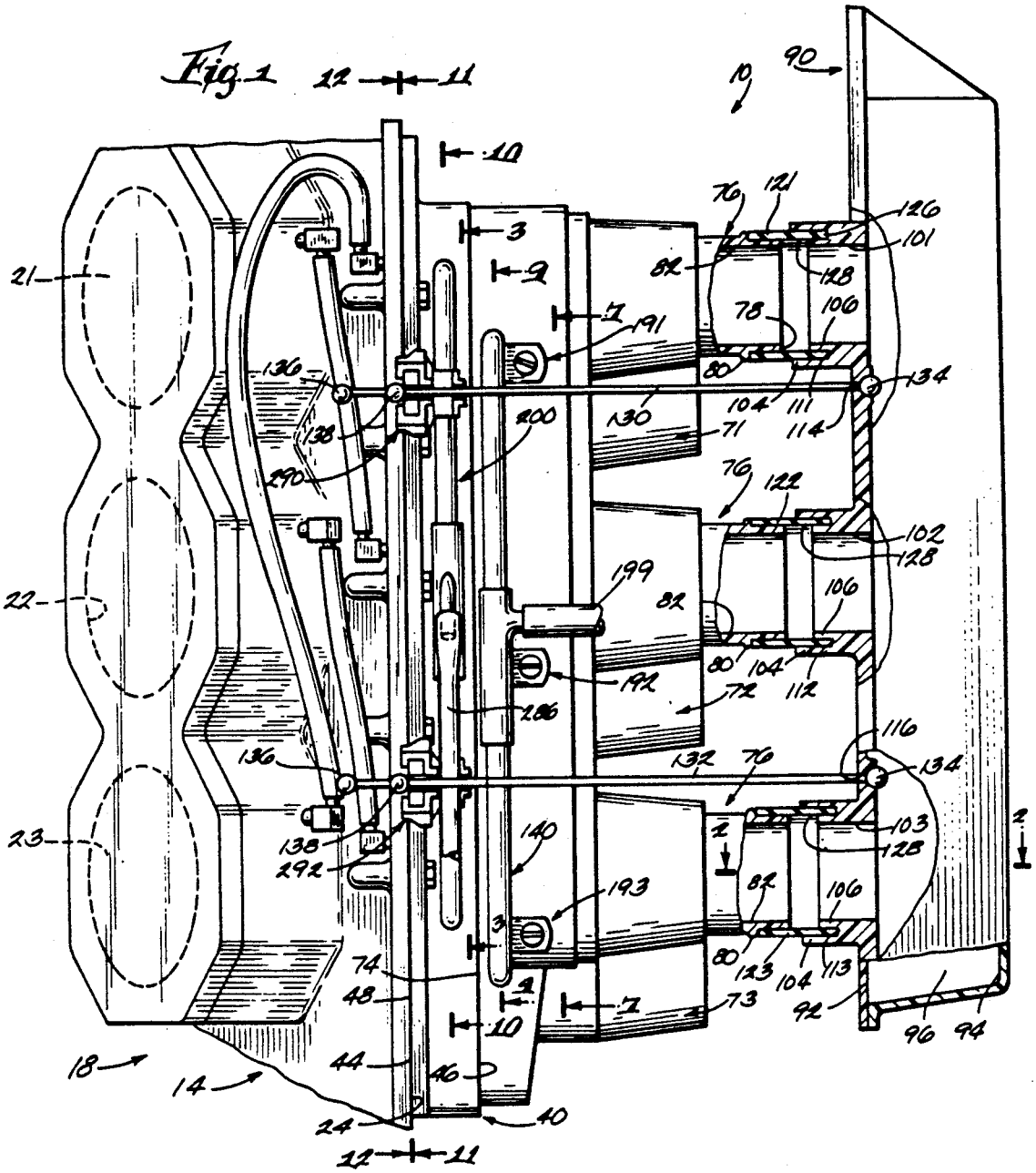
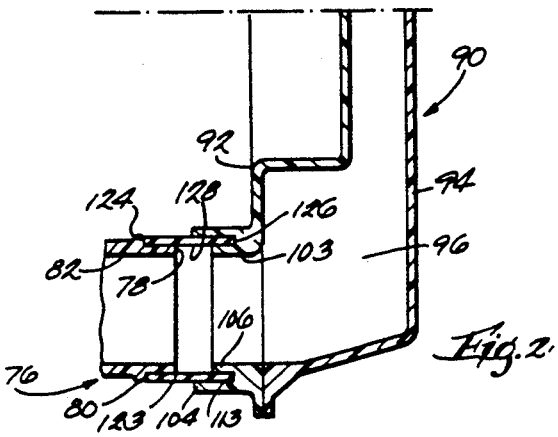
Fig. 2.

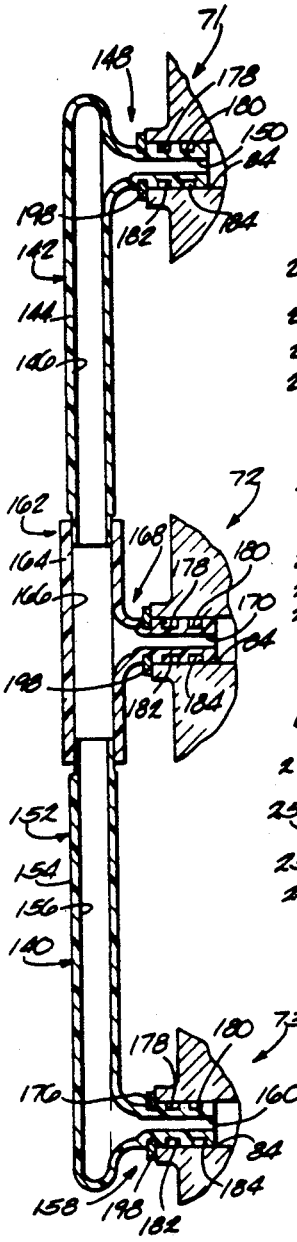
Fig. 9
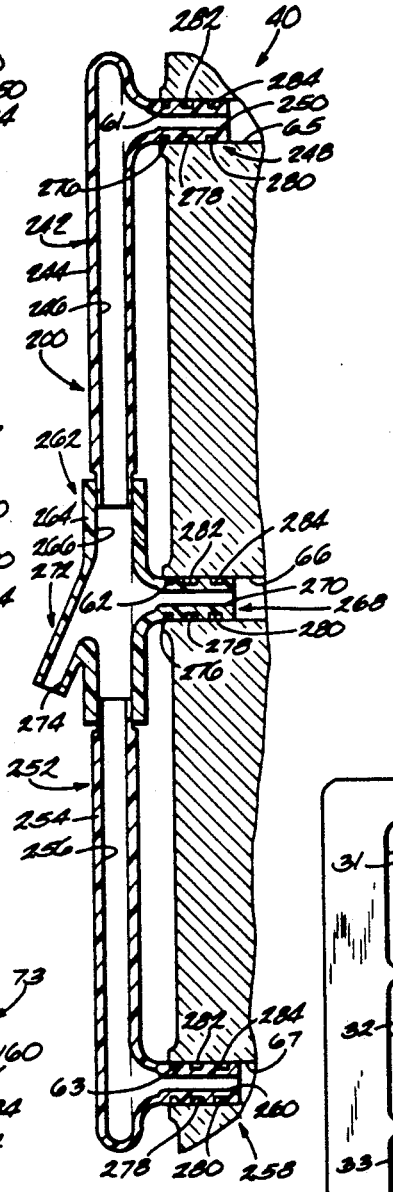
Fig. 10
Fig. 11
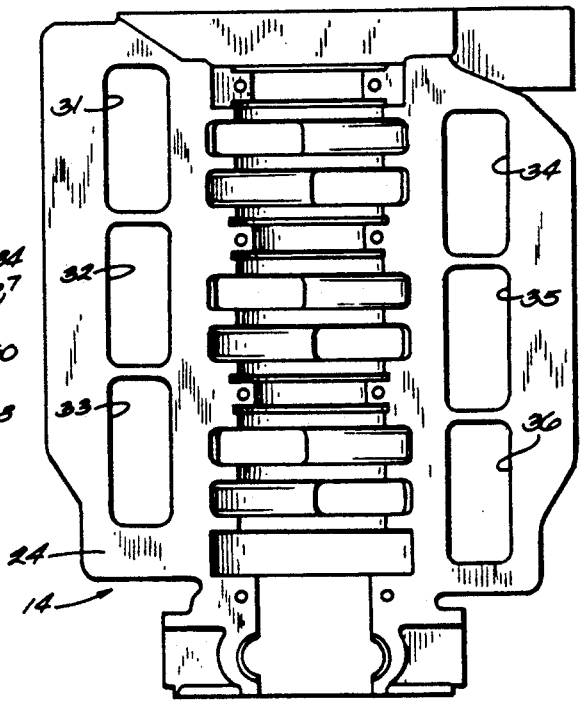

INTERNAL COMBUSTION ENGINE

BACKGROUND OF THE INVENTION

The invention relates to internal combustion engines, and more particularly to marine propulsion device internal combustion engines. Still more particularly, the invention relates to apparatus for supplying fuel and combustion air to marine propulsion device internal combustion engines.

U.S. Pat. No. 4,620,607, which is assigned to the assignee hereof, discloses an air silencer and an arrangement for mounting the air silencer on the intake manifold of an internal combustion engine. The air silencer is connected to the intake manifold by bolts threaded into the intake manifold.

Various arrangements are known for supplying fuel to the carburetors of an internal combustion engine. It is known to use fuel hoses and plastic fittings to form fuel manifolds on engines with multiple carburetors. Also, it is known to connect a plurality of intake manifold intake passages to each other in order to balance the pressure in the intake passages.

Attention is directed to the following U.S. Pat. Nos.:

| | | |
|---|---|---|
| Whitley | 3,032,603 | May 1, 1962 |
| Cochran | 3,090,826 | May 21, 1963 |
| Tezuka, et al. | 4,263,882 | April 28, 1981 |
| Nelson | 4,264,047 | April 28, 1981 |
| Kimura | 4,312,487 | Jan. 26, 1982 |
| Beck | 4,407,472 | Oct. 4, 1983 |
| Schaty | 4,550,891 | Nov. 5, 1985 |
| Breckenfeld, et al. | 4,569,415 | Feb. 11, 1986 |
| Breckenfeld, et al. | 4,620,607 | Nov. 4, 1986 |
| Munch | 4,779,828 | Oct. 25, 1988 |
| Hundertmark | 4,836,506 | June 6, 1989 |

SUMMARY OF THE INVENTION

The invention provides an internal combustion engine comprising an engine block including a cylinder and a combustion air passage for supplying combustion air to the cylinder, an air silencer communicating with the combustion air passage, and means including an elastic connector for securing the air silencer to the engine block.

The invention also provides an internal combustion engine comprising an engine block including a cylinder and a combustion air passage for supplying combustion air to the cylinder, an air silencer communicating with the combustion air passage, a connector extending between the air silencer and the engine block and including an enlarged portion, and means for releasably securing the enlarged portion to one of the air silencer and the engine block.

The invention also provides an internal combustion engine comprising an engine block including a cylinder and a combustion air passage for supplying combustion air to the cylinder, a carburetor communicating with the combustion air passage and including an inlet portion, an air silencer communicating with the carburetor, and a tubular resilient member extending between the air silencer and the carburetor and including a portion surrounding the inlet portion of the carburetor.

The invention also provides an internal combustion engine comprising an engine block including first and second cylinders and first and second combustion air passages for supplying combustion air to the first and second cylinders, respectively, an intake manifold including first and second intake passages respectively communicating with the first and second combustion air passages, first conduit means communicating between the first and second intake passages, second conduit means, and clip means for releasably securing the first and second conduit means to the intake manifold.

The invention also provides an internal combustion engine comprising an engine block including first and second cylinders and first and second combustion air passages for supplying combustion air to the first and second cylinders, respectively, an intake manifold including first and second intake passages respectively communicating with the first and second combustion air passages, first conduit means communicating between the first and second intake passages, an air silencer communicating with the intake passages, a connector extending between the air silencer and the engine block, and clip means for releasably securing the first conduit means to the engine block, the clip means having therein a guide recess receiving the connector.

A principal feature of the invention is the provision of means including an elastic connector for securing an air silencer to an intake manifold and for facilitating removal of the air silencer. A plurality of elastic connectors extend between the air silencer and the intake manifold and are releasably secured to the intake manifold. The connectors can be easily disconnected from the intake manifold without any tools so that the air silencer can be removed from the carburetors.

Another principal feature of the invention is the provision of tubular resilient members extending between the carburetors and the air silencer, maintaining a space between the carburetors and the air silencer, and defining passageways communicating between the air silencer and the carburetors.

Another principal feature of the invention is the provision of clips which are releasably connected to the intake manifold and which secure both the balance manifold and the suction hose to the intake manifold. Furthermore, each of the clips has therein a guide recess receiving one of the elastic connectors extending between the air silencer and the intake manifold.

Other features and advantages of the invention will become apparent to those skilled in the art upon review of the following detailed description, claims and drawings.

DESCRIPTION OF THE DRAWINGS

FIG. 1 is a side elevational view of a marine propulsion device embodying the invention.

FIG. 2 is a view taken along line 2—2 in FIG. 1.

FIG. 9 is a view taken along line 9—9 in FIG. 1.

FIG. 10 is a view taken along line 10—10 in FIG. 1.

FIG. 11 is a view taken along line 11—11 in FIG. 1.

FIG. 12 is a view taken along line 12—12 in FIG. 1.

Figure 7:
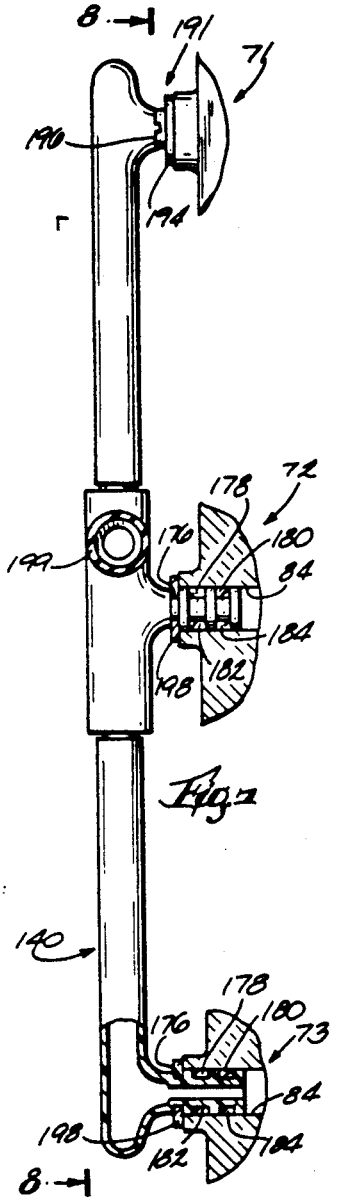
FIG. 7 is a view taken along line 7—7 in FIG. 1.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

An internal combustion engine 10 embodying the invention is illustrated in the drawings. While the engine 10 can have various suitable constructions and can be either a two-stroke or a four-stroke engine, the illustrated engine is a V-6, two-stroke engine.

The engine 10 includes (see FIG. 1) an engine block 14 defining two banks 18 of cylinders. Preferably, the engine block is substantially identical to the block disclosed in U.S. Ser. No. 315,900, now pending, which was filed Feb. 27, 1989, and which is incorporated herein by reference. Only one bank 18 of cylinders is illustrated in the drawings and described herein. The other cylinder bank 18 is essentially a mirror image of the one described. The cylinder bank 18 includes first, second and third cylinders 21, 22 and 23, respectively. The engine block 14 also includes (see FIG. 11) a manifold mounting surface 24, first, second and third combustion air passages 31, 32 and 33 extending from the manifold mounting surface 24 for supplying combustion air to the cylinders 21, 22 and 23, respectively, and combustion air passages 34, 35 and 36 extending from the manifold mounting surface 24 for supplying combustion air to the cylinders of the other bank.

Figure 3:
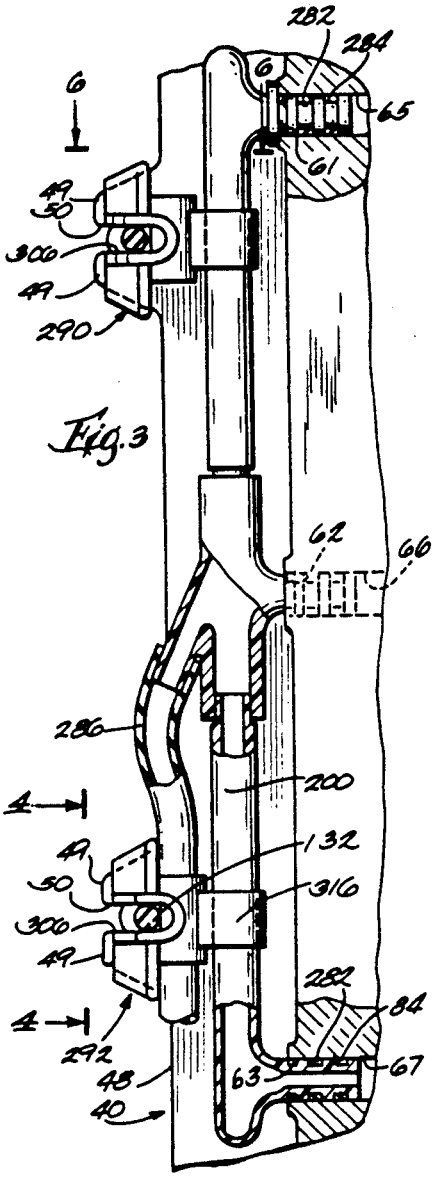
FIG. 3 is a view taken along line 3—3 in FIG. 1.

The engine 10 also includes (see FIG. 1) a pair of substantially identical intake manifolds 40 fixed to the engine block 14 by suitable means. Only the intake manifold 40 associated with the illustrated cylinder bank 18 is shown and described herein. The intake manifold 40 includes (see FIGS. 1 and 12) an engine mounting surface 44 abutting the manifold mounting surface 24 of the engine block 14, and an opposite carburetor mounting surface 46 (FIG. 1). The intake manifold 40 also includes (see FIGS. 1 and 3) a side surface 48 extending between the engine mounting surface 44 and the carburetor mounting surface 46. The side surface 48 includes (see FIG. 3) two pairs of spaced apart lateral projections 49 defining recesses 50, the reason for which is explained hereinafter. The intake manifold 40 has therethrough (see FIG. 12) first, second and third intake passages 51, 52 and 53 extending between the carburetor mounting surface 46 and the engine mounting surface 44 and respectively communicating with the first, second and third combustion air passages 31, 32 and 33 of the engine block 14. The intake manifold 40 further has therein (see FIGS. 3 and 10) first, second and third balance openings 61, 62 and 63 respectively communicating with the first, second and third intake passages 51, 52 and 53 via first, second and third balance passageways 65, 66 and 67. Preferably, the intake manifold 40 is substantially identical to the intake manifold disclosed in U.S. Ser. No. 482,932, which was filed Feb. 20, 1990, and which is incorporated herein by reference.

The engine 10 also includes (see FIG. 1) first, second and third carburetors 71, 72 and 73 associated with the illustrated intake manifold 40. (The engine 10 also includes carburetors which are associated with the other intake manifold, which are substantially identical to the carburetors 71, 72 and 73, and which are not shown or described herein.) Each carburetor 71, 72 or 73 includes (see FIG. 1) a manifold mounting surface 74 abutting the carburetor mounting surface 46 of the intake manifold 40. The carburetors 71, 72 and 73 can be mounted on the intake manifold 40 by any suitable means. Each carburetor 71, 72 or 73 also includes (see FIGS. 1 and 2) an intake portion 76 including an outer surface 78 opposite the manifold mounting surface 74. The intake portion 76 has thereon a shoulder 80, the reason for which is explained hereinafter. Each carburetor 71, 72 or 73 also includes an intake passage 82 extending between the outer surface 78 and the manifold mounting surface 74. The intake passage 82 of the first carburetor 71 communicates with the first intake manifold intake passage 51, the intake passage 82 of the second carburetor 72 communicates with the second intake manifold intake passage 52, and the intake passage 82 of the third carburetor 73 communicates with the third intake manifold intake passage 53. Each carburetor 71, 72 or 73 further includes (see FIGS. 7 and 9) a fuel supply opening 84, and means (not shown) communicating with the fuel supply opening 84 for supplying fuel to the carburetor intake passage 82. Such means is known in the art and will not be described in greater detail.

The engine 10 also includes (see FIGS. 1 and 2) an air silencer 90. The air silencer 90 includes spaced apart inner and outer walls 92 and 94 defining therebetween a silencing chamber 96. The inner wall 92 has therein (see FIG. 1) first, second and third outlet openings 101, 102 and 103 communicating with the silencing chamber 96 and with the first, second and third carburetors 71, 72 and 73, respectively, as described below. (The inner wall 92 also has therein openings (not shown) communicating with the carburetors associated with other cylinder bank.) The inner wall 92 also has thereon three pairs of radially spaced projections 104 and 106 defining first, second and third annular recesses 111, 112 and 113 respectively surrounding the first, second and third outlet openings 101, 102 and 103. The inner wall 92 of the air silencer 90 also has therethrough upper and lower openings 114 and 116, the reason for which is explained hereinafter.

The engine 10 also includes (see FIG. 1) first, second and third tubular resilient members 121, 122 and 123 respectively communicating with the first, second and third carburetors 71, 72 and 73 and with the first, second and third air silencer outlet openings 101, 102 and 103. Each resilient member 121, 122 or 123 has (see FIG. 2) a first or inner end 124 abutting the shoulder 80 on the associated carburetor 71, 72 or 73 so that a portion of the member 121, 122 or 123 surrounds the inlet portion 76 of the associated carburetor, and each member 121, 122 or 123 also has an opposite second end 126 housed in the associated recess 111, 112 or 113 in the air silencer 90. Each member 121, 122 or 123 forms a seal between the air silencer 90 and the associated carburetor 71, 72 or 73 and maintains a space between the air silencer 90 and the associated carburetor 71, 72 or 73, so that the member 121, 122 or 123 defines a passageway 128 communicating between the air silencer 90 and the intake passage 82 of the associated carburetor 71, 72 or 73.

The engine 10 further includes (see FIG. 1) means for securing the air silencer 90 to the intake manifold 40 (and thus to the engine block 14) and for facilitating removal of the air silencer 90 from the intake manifold 40 (and thus from the engine block 14). While various suitable means can be employed, in the illustrated construction, such means includes, on the illustrated side of the engine 10, upper and lower elastic connectors 130 and 132, respectively, extending between the air silencer 90 and the intake manifold 40. (The securing means also includes upper and lower connectors (not shown) on the other side of the engine 10.) While various suitable constructions can be used, in the illustrated embodiment, each connector 130 or 132 has an enlarged forward end 134, an enlarged rearward end 136, and an enlarged portion 138 adjacent but spaced from the rearward end 136. Each connector 130 or 132 extends through an associated one of the openings 114 and 116 in the air silencer wall 92 so that the enlarged forward end 134 abuts the inner wall 92 and prevents the forward end 134 of the connector 130 or 132 from being pulled rearwardly through the opening 114 or 116.

The means for securing the air silencer 90 to the intake manifold 40 also includes means for releasably securing the connectors 130 and 132 to the intake manifold 40 (and thus to the engine block 14). While various suitable means can be employed, in the illustrated construction, this means includes (see FIGS. 3–6) the recesses 50 in the intake manifold 40. More particularly, as shown in the drawings, each connector 130 or 132 extends through an associated one of the recesses 50 so that the enlarged portion 138 engages the engine mounting surface 44 of the intake manifold 40 and prevents the enlarged portion 138 from being pulled forwardly through the recess 50. Each connector 130 or 132 must be stretched from its relaxed state in order to locate the enlarged portion 138 in the associated recess 50. The enlarged rearward end 136 of each connector 130 or 132 facilitates gripping of the connector so that the connector can be stretched to locate the enlarged portion 138 in the associated recess 50 or to remove the enlarged portion 138 from the associated recess 50.

Figure 8:
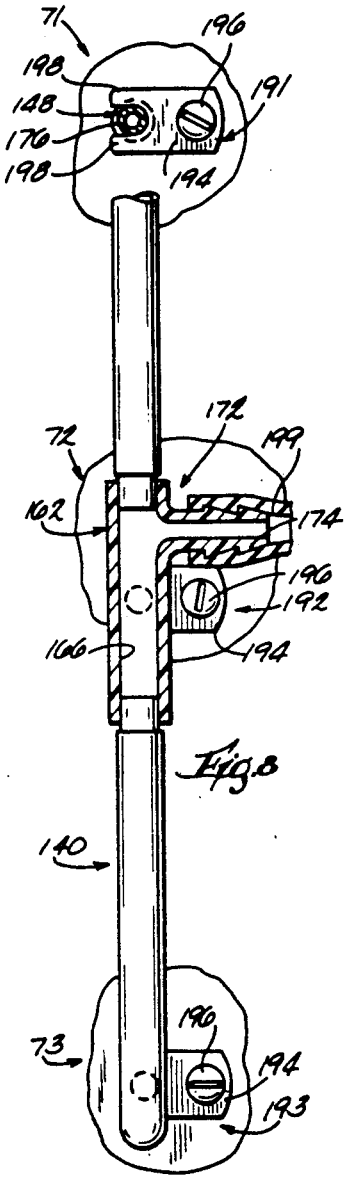
FIG. 8 is a view taken along line 8—8 in FIG. 7.

The engine 10 further includes (see FIGS. 1 and 7–9) a fuel manifold 140 for supplying fuel to the carburetors 71, 72 and 73. The fuel manifold 140 is preferably fabricated of plastic and includes (see FIG. 9) an integrally molded (i.e., injection molded as a single piece) first or upper manifold portion 142 comprising an elongated portion 144 defining a first or upper main passageway 146 having a closed upper end and an open lower end, and a first or upper nipple portion 148 defining a first or upper nipple passageway 150 communicating between the opening 84 in the first carburetor 71 and the upper main passageway 146 and extending transversely to the upper main passageway 146. The fuel manifold 140 also includes an integrally molded second or lower manifold portion 152 comprising an elongated portion 154 defining a second or lower main passageway 156 having a closed lower end and an open upper end, and a second or lower nipple portion 158 defining a second or lower nipple passageway 160 communicating between the opening 84 in the third carburetor 73 and the lower main passageway 156 and extending transversely to the lower main passageway 156. The fuel manifold 140 also includes an integrally molded third or center manifold portion 162 comprising an elongated portion 164 defining a third or center main passageway 166 having an open first or lower end communicating with the upper end of the lower main passageway 156, and having an open second or upper end communicating with the lower end of the upper main passageway 146. The center manifold portion 162 also comprises a third or center nipple portion 168 defining a third or center nipple passageway 170 communicating between the opening 84 in the second carburetor 72 and the center main passageway 166 and extending transversely to the center main passageway 166. The center manifold portion 162 also comprises (see FIG. 8) a fuel supply nipple 172 defining a nipple fuel passageway 174 communicating with the center main passageway 166. Preferably, the nipple fuel passageway 174 extends transversely to the center main passageway 166. Also, each of the nipple portions 148, 158 and 168 has therein (see FIGS. 7 and 9) first, second and third annular grooves or recesses 176, 178 and 180, respectively.

The manifold portions 142, 152 and 162 are connected by suitable means such as bonding. Because the upper and lower main passageways 146 and 156 communicate with the center main passageway 166, the upper and lower main passageways 146 and 156 also communicate with each other. In the illustrated construction, the main passageways 146, 156 and 166 are coaxial and the nipple passageways 150, 160 and 170 are generally parallel and extend substantially perpendicular to the main passageways 146, 156 and 166. The nipple passageway 174 is generally perpendicular to both the passageways 146, 156 and 166 and the passageways 150, 160 and 170.

The engine 10 further includes (see FIGS. 7 and 9) sealing means surrounding each of the nipple portions 148, 158 and 168 and sealingly engaging the associated carburetor 71, 72 or 73 and the associated nipple portion 148, 158 or 168. While various suitable means can be employed, in the illustrated construction, such means includes, for each of the nipple portions 148, 158 and 168, an O-ring 182 seated in the second groove 178 and an O-ring 184 seated in the third groove 180.

The engine 10 further includes (see FIGS. 7–9) means for securing the fuel manifold 140 to the carburetors 71, 72 and 73. While various suitable securing means can be employed, in the illustrated embodiment, such means includes (see FIG. 8) first clip means 191 which is fixed to the first carburetor 71 and which engages the upper nipple portion 148, second clip means 192 which is fixed to the second carburetor 72 and which engages the center nipple portion 168, and third clip means 193 which is fixed to the third carburetor 73 and which engages the lower nipple portion 158. Preferably, each of the clip means 191, 192 and 193 includes (see FIG. 8) a clip 194 fixed to the associated carburetor 71, 72 or 73 by a bolt or screw 196 threaded into the carburetor 71, 72 or 73. Each clip 194 includes (see FIGS. 8 and 9) spaced apart projections 198 extending into the first recess 176 in the associated nipple portion 148, 158 or 168 so as to prevent axial movement of the nipple portion relative to the associated carburetor 71, 72 or 73.

The engine 10 further includes (see FIGS. 1, 7 and 8) means for supplying fuel to the fuel manifold 140. While various suitable means can be used, in the illustrated construction, such means includes a fuel supply conduit 199 communicating between a suitable source of fuel (not shown) and the fuel supply nipple 172.

The engine 10 further includes (see FIGS. 1, 3 and 10) a balance manifold 200 communicating between the first, second and third intake manifold intake passages 51, 52 and 53. The balance manifold 200 is preferably fabricated of plastic and includes (see FIG. 10) an integrally molded first or upper manifold portion 242 comprising an elongated portion 244 defining a first or upper main passageway 246 having a closed upper end and an open lower end, and a first or upper nipple portion 248 defining a first or upper nipple passageway 250 communicating between the first opening 61 in the intake manifold 40 and the upper main passageway 246 and extending transversely to the upper main passageway 246. The balance manifold 200 also includes an integrally molded second or lower manifold portion 252 comprising an elongated portion 254 defining a second or lower main passageway 256 having a closed lower end and an open upper end, and a second or lower nipple portion 258 defining a second or lower nipple passageway 260 communicating between the third opening 63 in the intake manifold 40 and the lower main passageway 256 and extending transversely to the lower main passageway 256. The balance manifold 200 also includes an integrally molded third or center manifold portion 262 comprising an elongated portion 264 defining a third or center main passageway 266 having an open first or lower end communicating with the upper end of the lower main passageway 256, and having an open second or upper end communicating with the lower end of the upper main passageway 246. The center manifold portion 262 also comprises a third or center nipple portion 268 defining a third or center nipple passageway 270 communicating between the second opening 62 in the intake manifold 40 and the center main passageway 266 and extending transversely to the center main passageway 266. The center manifold portion 262 also comprises a suction nipple 272 defining a suction passageway 274 communicating with the center main passageway 266. Preferably, the suction passageway 274 extends transversely to the center main passageway 266. Also, each of the nipple portions 248, 258 and 268 has therein first, second and third annular grooves or recesses 276, 278 and 280.

The manifold portions 242, 252 and 262 are connected by suitable means such as bonding. In the illustrated construction, the main passageways 246, 256 and 266 are coaxial and the nipple passageways 250, 260 and 270 are generally parallel and extend substantially perpendicular to the main passageways 246, 256 and 266. The nipple passageway 274 extends in the same plane as the passageways 246, 256, 266, 250, 260 and 270. Preferably, the upper and lower manifold portions 242 and 252 are respectively identical to the upper and lower manifold portions 142 and 152.

The engine 10 further includes (see FIGS. 3 and 10) sealing means surrounding each of the nipple portions 248, 258 and 268 and sealingly engaging the intake manifold 40 and the associated nipple portion 248, 258 or 268. While various suitable means can be employed, in the illustrated construction, such means includes, for each of the nipple portions 248, 258 and 268, an O-ring 282 seated in the second groove 278 and an O-ring 284 seated in the third groove 280.

The engine 10 further includes (see FIGS. 1 and 3) a suction conduit 286 having one end communicating with the suction nipple 272. The opposite end of the suction conduit 286 communicates with a suitable location such as the air silencer or the main bearing drain.

The engine 10 further includes (see FIGS. 1 and 3–6) means for securing the balance manifold 200 to the intake manifold 40 and for securing the suction conduit 286 to the intake manifold 40. While various suitable means can be employed, in the illustrated embodiment such means includes clip means for releasably securing the balance manifold 200 and the suction conduit 286 to the intake manifold 40. In the illustrated construction, the clip means includes (see FIGS. 1 and 3) upper and lower clips 290 and 292, respectively. The clips 290 and 292 are substantially identical, and only the lower clip 292 will be described herein.

Figure 5:
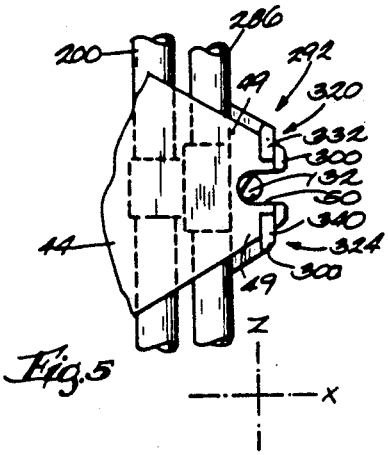
FIG. 5 is a view taken along line 5—5 in FIG. 4.
Figure 4:
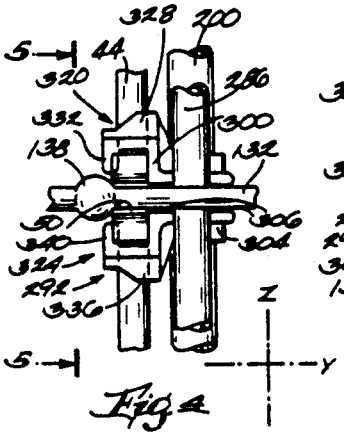
FIG. 4 is a view taken along line 4—4 in FIG. 3.
Figure 6:
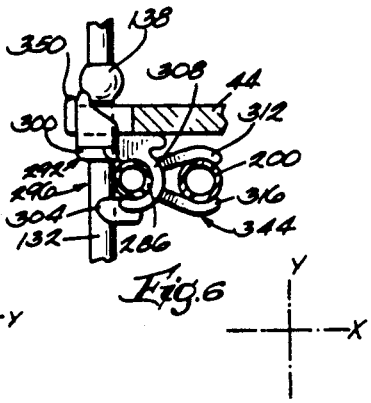
FIG. 6 is a view taken along line 6—6 in FIG. 3.
Figure 22:
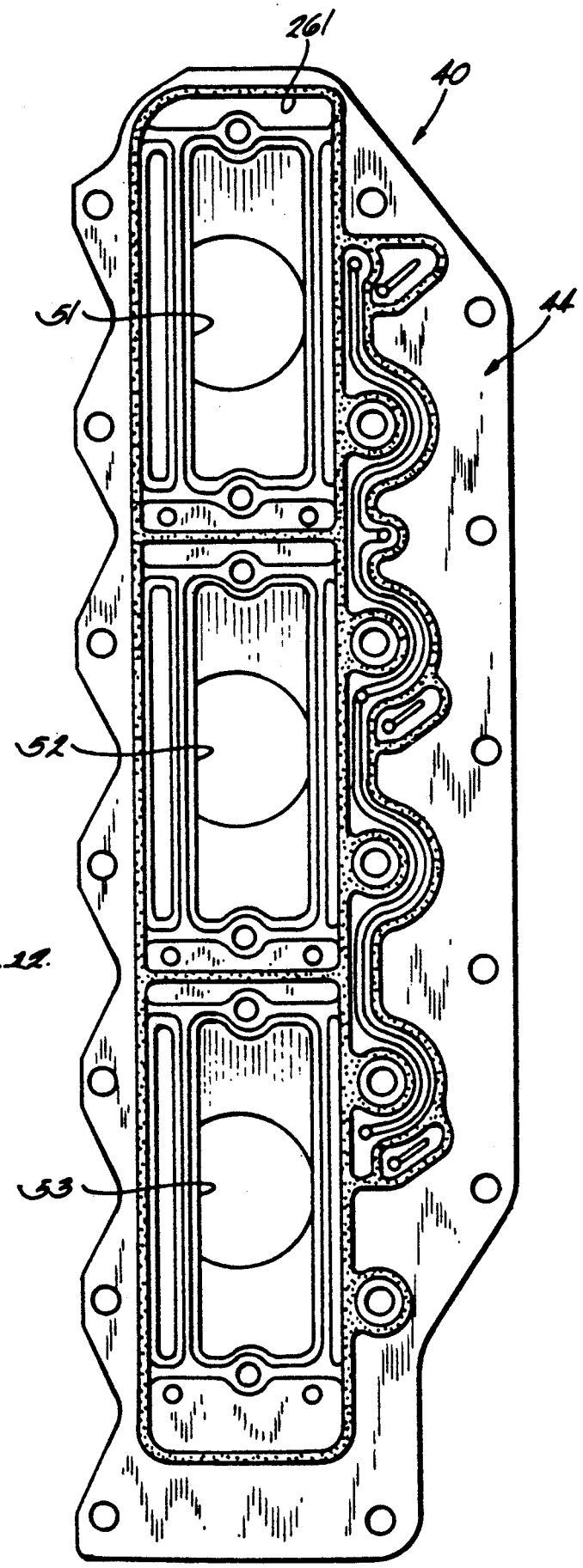

The clip 292 will be described by reference to mutually perpendicular X, Y and Z axes which are shown in FIGS. 4–6. The clip 292 includes (see FIG. 6) a generally C-shaped portion 296 including spaced-apart legs 300 and 304 extending generally parallel to the X axis. The legs 300 and 304 have therein (see FIGS. 3 and 4) aligned guide recesses 306. The C-shaped portion 296 also includes (see FIG. 6) a base portion 308 connecting the legs 300 and 304. The clip 292 also includes a pair of spaced-apart arms 312 and 316 extending from the base portion 308, extending generally parallel to the X axis, and extending in the opposite direction from the legs 300 and 304. The clip 292 also includes (see FIGS. 4 and 5) a pair of spaced-apart L-shaped extensions 320 and 324 extending from the leg 300. The first extension 320 includes (see FIG. 4) a first portion 328 extending from the leg 300, extending generally parallel to the Y axis, and extending in the direction away from the leg 304. The extension 320 also includes a second portion 332 spaced from the leg 300, extending from the first portion 328, extending generally parallel to the Z axis, and extending toward the L-shaped extension 324. The second L-shaped extension 324 includes (see FIG. 4) a first portion 336 extending from the leg 300, extending generally parallel to the Y axis, and extending in the direction away from the leg 304. The second extension 324 also includes a second portion 340 spaced from the leg 300, extending from the first portion 336, extending generally parallel to the Z axis, and extending toward the L-shaped extension 320. The second portions 332 and 340 of the L-shaped extensions 320 and 324 are preferably generally colinear. The arms 312 and 316 define a first clip portion 344 (FIG. 6) which releasably retains the balance manifold 200. The C-shaped portion 296 defines a second clip portion. The second clip portion or C-shaped portion 296 of the clip 292 releasably retains the suction conduit 286. As shown in FIG. 4, the connector 132 extends through the guide recesses 306 of the lower clip 292 and also extends over the suction conduit 286 so as to retain the suction conduit 286 in the second clip portion or C-shaped portion 296.

The clips 290 and 292 are preferably releasably connected to the intake manifold 40. In the illustrated construction, each of the extensions 320 and 324 fits over an associated projection 49, each of the intake manifold projections 49 has thereon (see FIGS. 4 and 6) a rearwardly extending projection 350, and the portions 332 and 340 of each clip 290 and 292 snap over the associated projections 350.

Various features of the invention are set forth in the following claims.

We claim:

1. An internal combustion engine comprising an engine block including a cylinder and a combustion air passage for supplying combustion air to said cylinder, an air silencer communicating with said combustion air passage, and means including an elastic connector for securing said air silencer to said engine block, said elastic connector including a first part connected to said air silencer and a second part connected to said engine block independently of said air silencer.

2. An engine as set forth in claim 1 and further comprising a carburetor communicating with said combustion air passage, and wherein said air silencer communicates with said carburetor.

3. An internal combustion engine comprising an engine including a cylinder and a combustion air passage for supplying combustion air to said cylinder, a carburetor communicating with said combustion air passage, an air silencer communicating with said carburetor, means including an elastic connector for securing said air silencer to said engine block, and a resilient member located between said air silencer and said carburetor and compressed by said securing means.

4. An engine as set forth in claim 3 wherein said resilient member forms a seal between said air silencer and said carburetor.

5. An engine as set forth in claim 4 wherein said carburetor has thereon a shoulder, wherein said air silencer has therein an annular recess, and wherein said resilient member has a first end abutting said shoulder and a second end housed in said recess.

6. An engine as set forth in claim 5 and further comprising an intake manifold which is fixed to said engine block and which communicates with said combustion air passage, wherein said air silencer communicates with said intake manifold, wherein said connector extends between said air silencer and said intake manifold, and wherein said enlarged portion is releasably secured to said intake manifold.

7. An engine as set forth in claim 1 and further comprising an intake manifold which is fixed to said engine block and which communicates with said combustion air passage, and wherein said connector extends between said air silencer and said intake manifold.

8. An engine as set forth in claim 7 and further comprising a carburetor communicating with said intake manifold, and wherein said air silencer communicates with said carburetor.

9. An engine as set forth in claim 1 wherein said securing means facilitates removal of said air silencer from said engine block.

10. An engine as set forth in claim 9 wherein said securing means includes means for releasably securing said connector to one of said air silencer and said engine block.

11. An engine as set forth in claim 10 wherein said connector has an enlarged portion, and wherein said securing means includes means for releasably securing said enlarged portion to said one of said air silencer and said engine block.

12. An engine as set forth in claim 10 wherein said connector is releasably secured to said engine block.

13. An engine as set forth in claim 12 and further comprising an intake manifold which is fixed to said engine block and which communicates with said combustion air passage, and wherein said connector extends between said air silencer and said intake manifold and is releasably secured to said intake manifold.

14. An engine as set forth in claim 13 and further comprising a carburetor communicating with said intake manifold, and wherein said air silencer communicates with and is secured to said carburetor.

15. An engine as set forth in claim 13 and further comprising clip means which is connected to said intake manifold and which has therein a guide recess receiving said connector.

16. An engine as set forth in claim 15 wherein said engine block includes first and second cylinders and first and second combustion air passages for supplying combustion air to said first and second cylinders, respectively, wherein said intake manifold includes first and second intake passages respectively communicating with said first and second combustion air passages, wherein said engine further comprises first conduit means communicating between said first and second intake passages, and wherein said clip means releasably secures said first conduit means to said intake manifold.

17. An engine as set forth in claim 16 and further comprising second conduit means, and wherein said clip means also releasably secures said second conduit means to said intake manifold.

18. An engine as set forth in claim 17 wherein said engine also comprises a bearing drain, and wherein said second conduit means communicates with said first conduit means and with one of said air silencer and said bearing drain.

19. An engine as set forth in claim 17 wherein said clip means includes a first clip portion releasably retaining said first conduit means, and a second clip portion releasably retaining said second conduit means.

20. An engine as set forth in claim 15 wherein said clip means is releasably connected to said intake manifold.

21. An internal combustion engine comprising an engine block including a cylinder and a combustion air passage for supplying combustion air to said cylinder, an intake manifold which is fixed to said engine block and which communicates with said combustion air passage, an air silencer which communicates with said intake manifold, a connector which extends between said air silencer and said intake manifold and which includes an enlarged portion, and means for releasably securing said enlarged portion to one of said air silencer and said intake manifold.

22. An engine as set forth in claim 21 and further comprising a carburetor communicating with said intake manifold, and wherein said air silencer communicates with said carburetor.

23. An engine as set forth in claim 22 and further comprising a resilient member located between said air silencer and said carburetor.

24. An engine as set forth in claim 23 wherein said carburetor includes an inlet portion, and wherein said resilient member is tubular and includes a portion surrounding said inlet portion of said carburetor.

25. An engine as set forth in claim 24 wherein said carburetor has thereon a shoulder, wherein said air silencer has therein an annular recess, and wherein said resilient member has a first end abutting said shoulder and a second end housed in said recess.

26. An engine as set forth in claim 21 wherein said enlarged portion is releasably secured to said intake manifold.

27. An engine as set forth in claim 26 and further comprising clip means which is connected to said intake manifold and which has therein a guide recess receiving said connector.

28. An engine as set forth in claim 27 wherein said engine block includes first and second cylinders and first and second combustion air passages for supplying combustion air to said first and second cylinders, respectively, wherein said intake manifold includes first and second intake passages respectively communicating with said first and second combustion air passages, wherein said engine further comprises first conduit means communicating between said first and second intake passages, and wherein said clip means releasably secures said first conduit means to said intake manifold.

29. An engine as set forth in claim 28 and further comprising second conduit means, and wherein said clip means also releasably secures said second conduit means to said intake manifold.

30. An engine as set forth in claim 29 wherein said engine also comprises a bearing drain, and wherein said second conduit means communicates with said first conduit means and with one of said air silencer and said bearing drain.

31. An engine as set forth in claim 29 wherein said clip means includes a first clip portion releasably retaining said first conduit means, and a second clip portion releasably retaining said second conduit means.

32. An engine as set forth in claim 27 wherein said clip means is releasably connected to said intake manifold.

33. An internal combustion engine comprising an engine block including a cylinder and a combustion air passage for supplying combustion air to said cylinder, a carburetor communicating with said combustion air passage and including an inlet portion and having thereon a shoulder, an air silencer which communicates with said carburetor and which has therein an annular recess, and a tubular resilient member which extends between said air silencer and said carburetor, which includes a portion surrounding said inlet portion of said carburetor, and which has a first end abutting said shoulder and a second end housed in said recess.

34. An engine as set forth in claim 33 wherein said resilient member maintains a space between said carburetor and said air silencer and defines a passageway communicating between said air silencer and said carburetor.

35. An engine as set forth in claim 33 wherein said resilient member forms a seal between said air silencer and said carburetor.

36. An internal combustion engine comprising an engine block including first and second cylinders and first and second combustion air passages for supplying combustion air to said first and second cylinders, respectively, an intake manifold including first and second intake passages respectively communicating with said first and second combustion air passages, first conduit means communicating between said first and second intake passages, second conduit means, and clip means for releasably securing said first and second conduit means to said intake manifold.

37. An engine as set forth in claim 36 wherein said engine also comprises a bearing drain, and wherein said second conduit means communicates with said first conduit means and with one of said air silencer and said bearing drain.

38. An engine as set forth in claim 36 wherein said clip means includes a first clip portion releasably retaining said first conduit means, and a second clip portion releasably retaining said second conduit means.

39. An engine as set forth in claim 36 wherein said clip means is releasably connected to said intake manifold.

40. An internal combustion engine comprising an engine block including first and second cylinders and first and second combustion air passages for supplying combustion air to said first and second cylinders, respectively, an intake manifold including first and second intake passages respectively communicating with said first and second combustion air passages, first conduit means communicating between said first and second intake passages, an air silencer communicating with said intake passages, a connector extending between said air silencer and said engine block, and clip means for releasably securing said first conduit means to said engine block, said clip means having therein a guide recess receiving said connector.

41. An engine as set forth in claim 40 wherein said intake manifold is fixed to said engine block, and wherein said connector extends between said air silencer and said intake manifold.

42. An engine as set forth in claim 40 wherein said clip means includes a first clip portion releasably retaining said first conduit means.

43. An engine as set forth in claim 42 wherein said connector retains said first conduit means in said first clip portion.

44. An engine as set forth in claim 40 and further comprising second conduit means, and wherein said clip means releasably secures said second conduit means to said engine block.

45. An engine as set forth in claim 44 wherein said engine also comprises a bearing drain, and wherein said second conduit means communicates with said first conduit means and with one of said air silencer and said bearing drain.

46. An engine as set forth in claim 40 wherein said clip means is releasably connected to said engine block.

* * * * *